US006820282B1

(12) United States Patent
England et al.

(10) Patent No.: US 6,820,282 B1
(45) Date of Patent: Nov. 23, 2004

(54) GOLF GLOVE

(75) Inventors: Robert L. England, Pensacola Beach, FL (US); Kenneth S. Litke, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/672,446

(22) Filed: Sep. 26, 2003

(51) Int. Cl.[7] ..... A41D 19/00
(52) U.S. Cl. ..... 2/161.1
(58) Field of Search ..... 2/16, 20, 159, 2/160, 161.1, 161.2, 161.4, 161.6; 224/183, 918

(56) References Cited

U.S. PATENT DOCUMENTS

| | | | | |
|---|---|---|---|---|
| 986,158 | A | 3/1911 | Florsheim | |
| 2,187,987 | A | 1/1940 | Sherrick | 2/160 |
| 3,185,483 | A | 5/1965 | Klynman | 273/162 |
| 3,462,862 | A | 8/1969 | Chase | 224/183 |
| 3,895,797 | A | 7/1975 | Moore | 273/32 A |
| 4,489,444 | A | 12/1984 | Graham | 2/160 |
| 5,282,616 | A | 2/1994 | Stacavich-Notaro | 273/32 A |
| 5,305,999 | A | 4/1994 | Tate | 273/32 B |
| 5,365,609 | A | 11/1994 | Herzog | 2/161.4 |
| 5,715,539 | A | 2/1998 | Benecki et al. | 2/160 |
| 5,740,557 | A | 4/1998 | Reid et al. | 2/209.13 |
| 5,795,248 | A | 8/1998 | Giglio | 224/918 |
| 5,860,167 | A | 1/1999 | Lizio | 2/209.13 |
| 5,898,946 | A | 5/1999 | Keating et al. | 2/209.13 |
| 5,930,839 | A | 8/1999 | Schupp | 2/209.13 |
| 5,996,116 | A | 12/1999 | Tate | 2/12 |
| 6,004,229 | A | * 12/1999 | Fazekas | 473/406 |
| 6,163,889 | A | 12/2000 | Tate | 2/209.13 |
| 6,170,088 | B1 | 1/2001 | Tate | 2/209.13 |
| 6,173,451 | B1 | 1/2001 | DeVincenzi | 2/162 |
| 6,175,963 | B1 | 1/2001 | Loeffelholz | 2/204.13 |
| 6,513,165 | B1 | 2/2003 | England et al. | 2/161.2 |

* cited by examiner

*Primary Examiner*—Gary L. Welch
(74) *Attorney, Agent, or Firm*—D. Michael Burns

(57) ABSTRACT

A combination golf glove and golf ball marker for detachably securing a ball marker of ferromagnetic material to a magnet embedded within a holder. The marker holder having an improvement in the manner the magnet is embedded into the holder. The holder having a first aperture in the base, seating therein a generally rectangular magnet, which holds the ball marker until it is dislodged by a greater force.

8 Claims, 3 Drawing Sheets

GOLF GLOVE

FIELD OF INVENTION

The invention relates generally to a ball marker removably affixed to a golf glove, and more specifically, to a system for retaining the marker on the golf glove with a magnet.

BACKGROUND OF THE INVENTION

Golf ball markers have been used for many years in order to mark the position of a golf ball on a fairway or green during a game of golf. Golf ball markers are typically formed as small, disk-shaped structures, usually fabricated from plastic or metal.

Golfers have long been faced with the difficulties of transporting ball markers around the links and keeping them conveniently at hand while leaving their hands free to play the game. Although the golf bag generally used to transport the clubs includes pockets in which markers may be stored and transported, such pockets are not well suited for providing easy access to small items. Use of pockets in the golfer's clothing is similarly unsatisfactory. Items stored in the shirt pockets may fall out and be lost when the player bends to tee up or place a marker. Quite often, the ball marker is carried in a player's trouser pocket, and the player is thus forced to dig and fumble through the contents of the pocket in order to retrieve it.

Golf ball markers have similar sizes and shapes to coins, which are often carried in the same pocket. A golf ball marker therefore cannot be easily separated from the other contents of the pocket by the sense of touch. The retrieval of a golf ball marker for use thereby creates a source of annoyance and distraction to the golfer.

Systems for enhancing the convenience of access of ball markers have been devised. For example, golf ball markers may be releasably mounted by means of magnets in items such as golf divot tools. U.S. Pat. No. 6,163,889, discloses a method of securing a golf ball marker on an article of clothing. In this patent, a metal ball marker is retained by a means of a magnet that is attached to clothing material by an adhesive. U.S. Pat. No. 5,898,946 is another example of a metal ball marker held in place by virtue of magnetic attraction.

U.S. Pat. No. 5,305,999, shows a golf accessory with a magnet holding a ball marker. The patent shows a portion of the magnet being eliminated, whereby the ball marker can be easily removed by pressing it into the tail void created by the eliminated portion of the magnet, thereby allowing it to be "flipped up".

U.S. Pat. No. 6,513,165, shows a golf glove with a magnet holding a ball marker. The magnet is held in place a retaining wall that is partially cut-out to allow the ball marker to be able to easily slide out of the holder.

Accordingly, it is seen that there is a need for device for holding golf ball markers that would be simple to use, inexpensive, and which would not necessarily constitute an item of apparel in addition to that normally worn by golfers. It would also be seen desirable to have a golf marker that would serve to display a logo, insignia or other personalized surface embellishments.

SUMMARY OF THE INVENTION

The present invention is directed to a ball marker or custom logo medallion holder which is open and readily accessible to a golfer. Providing such a holder which is compact and light weight and easily accessible when placed on a golf glove or other clothing article permits easy one-handed access to the marker for removal and replacement.

The present invention provides for an improved ball marker holder that is sewn into the outer surface of the glove so that the ball marker is visible. The visibility allows for the use of logos, advertisements, personalization, pad printed, adhesive stickers and other indicia to be printed, embossed etc. on the upper side of the marker or medallion.

The invention provides for the retention of the marker within a holder by a magnet that is embedded in the base of the holder. The marker need only be a disc made of some magnetically attractive metal. The improved design, whereby the marker holder has a portion of its retaining wall cut away, allows for convenient, one-hand, easy removal and replacement of the marker. The magnet, which is embedded in an aperture of the base, occupies only a portion of the base, thereby offering more flexibility than a larger magnet.

DETAILED DESCRIPTION OF THE INVENTION

Figure 2:
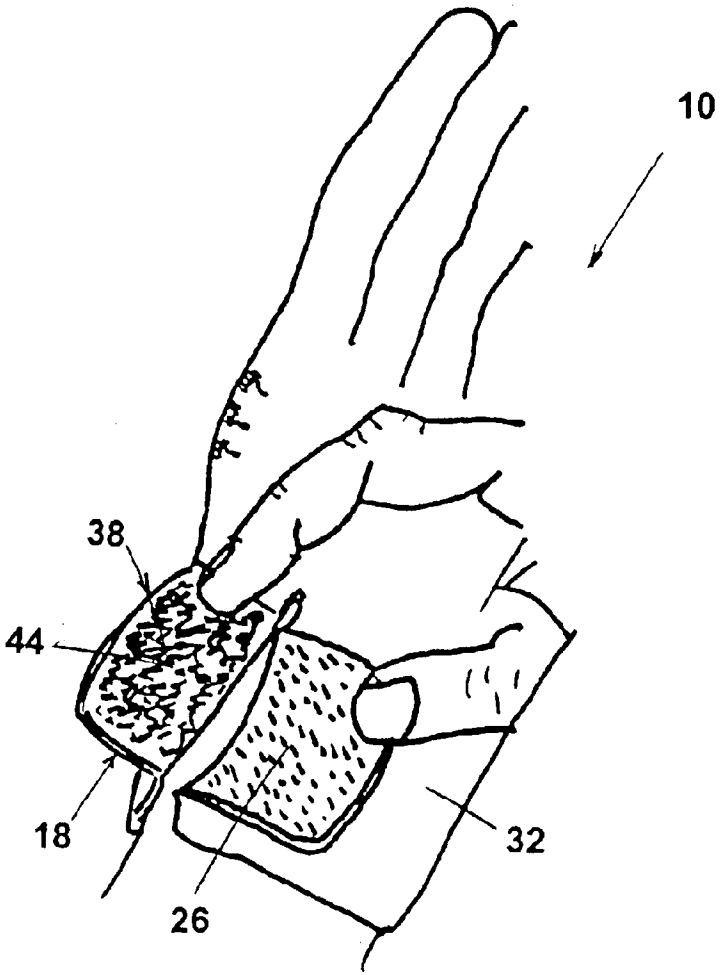
FIG. 2 is a pictorial view of the hook and loop fastening system.
Figure 1:
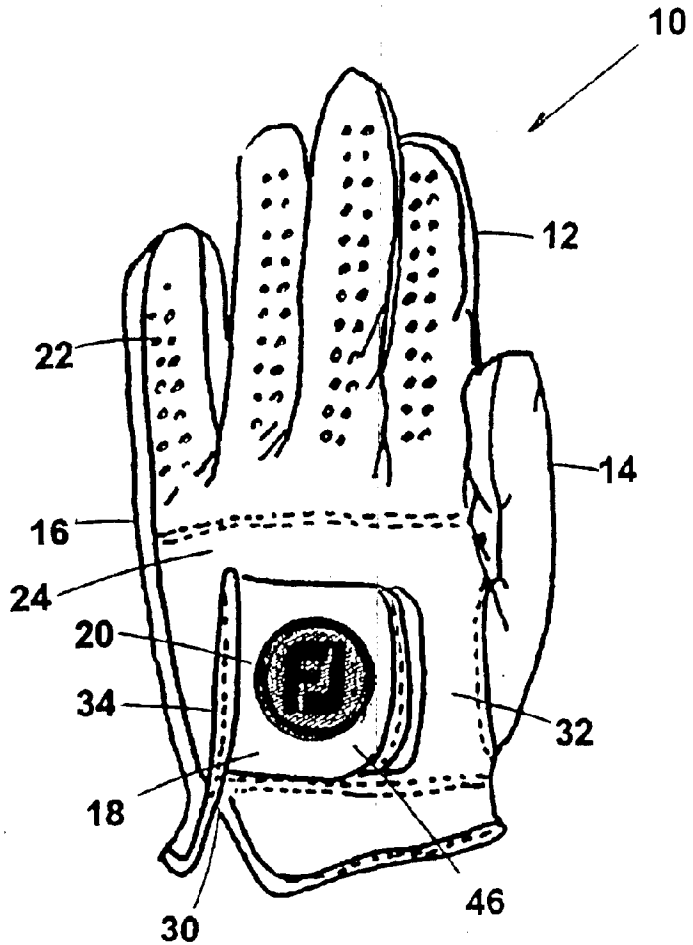
FIG. 1 is a pictorial view of the back surface of a golf glove and golf ball marker mounted on the glove.

Referring now to the drawings, FIGS. 1–2 describe a golf glove of the type often worn by golfers to ensure a firm grip on a club handle. Like conventional golf gloves, the glove 10 includes having fingers 12, a thumb 14, a body 16, and closure assembly 18. For the present invention a ball marker holder 20 is attached to closure assembly 18.

In more detail, glove 10 is of flexible construction, preferably of leather and is perforated with ventilation holes 22 on the dorsal surface of fingers 12. Glove body 16 includes a front surface (not shown), and a dorsal, back surface 24 which is divided by an opening 30 into a lateral portion 32 adjacent the thumb 14 and a medial portion 34.

Glove closure assembly 18 includes a generally rectangular area of fabric loop fastener material 26, attached to lateral back surface 32 by a row of marginal stitching. A generally rectangular flap 38 is coupled with medial portion 34 so as to overlie fastener material 26 in mating engagement when in the closed position. Flap 38 includes an inner surface 44 of fabric loop fastener material and an outer surface 46 joined by stitching. The fabric hook and loop closure system is conventional, and need not be described in great detail. In other embodiments, snaps, buttons, or any other suitable closure devices may be substituted for fabric loop fastener material or hook and loop fasteners in closure assembly 18.

Figure 3:
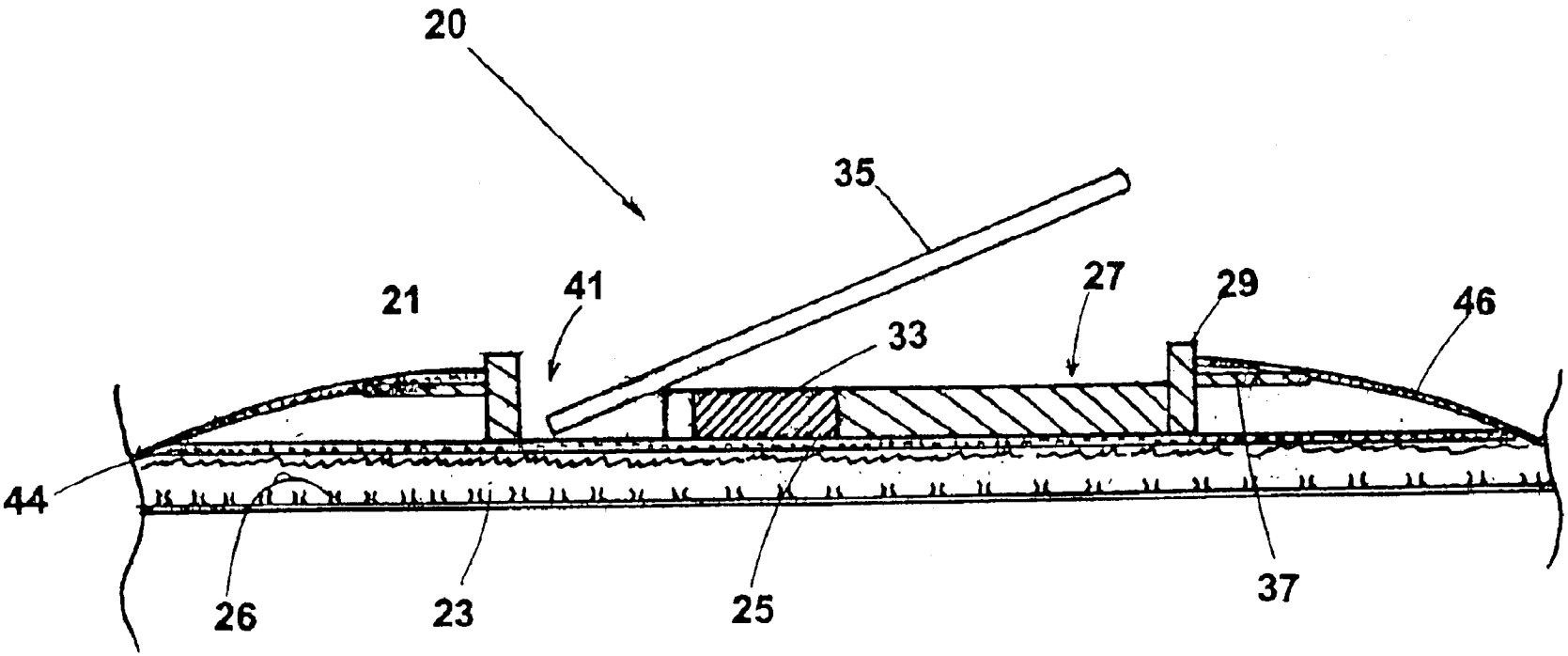
FIG. 3 is a side view of the golf ball marker attached to the glove.
Figure 6:
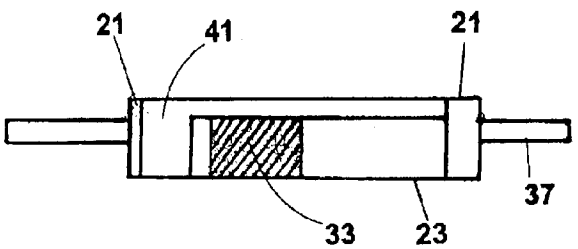
FIG. 6 is an elevation side of the holder taken along line B—B of FIG. 4.
Figure 7:
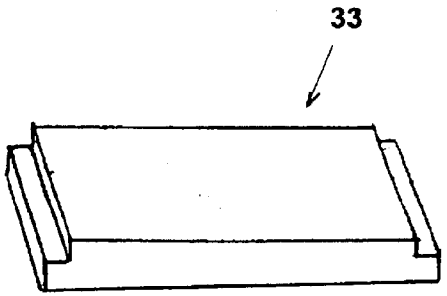
FIG. 7 is a pictorial view of the magnet.
Figure 4:
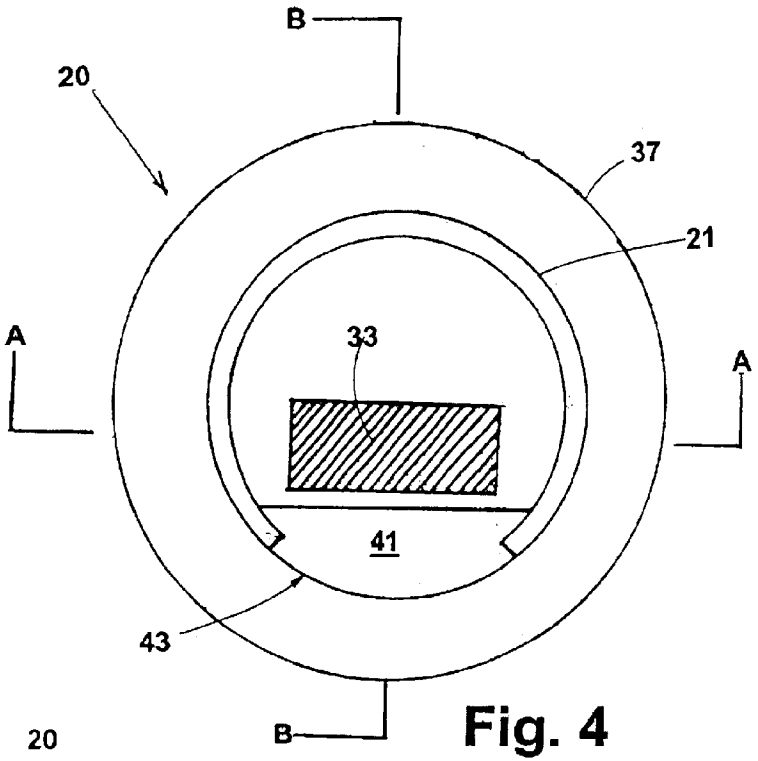
FIG. 4 is a top view of the holder without the marker.
Figure 5:
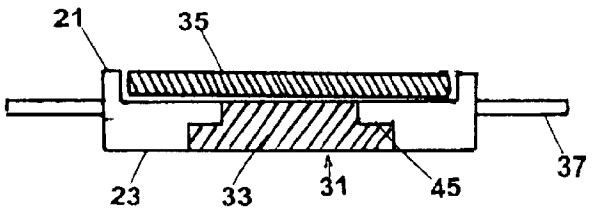
FIG. 5 is an elevation view of the holder taken from along line A—A of FIG. 4, with the addition of the ball marker.

Of greater significance, as concerning the present invention, is the presence of a generally flat, rectangular magnet 33, which is located within the ball marker holder 20, as shown in FIGS. 3–6. The ball marker holder 20, as seen in FIGS. 3–6, includes a generally circular retaining wall 21, partially closed at a bottom end 23 with a base portion 25, while having an opening 27 at the top end 29. The base portion 25 has a first aperture 31 defined therein for placement of magnet 33. The magnet 33 is designed with a size and configuration to be received within the first aperture 31, as seen in FIG. 7. First aperture 31 having an edge section 45 for receiving the magnet 33. The base portion 25 includes a chord section C—C, as seen in FIG. 4, to define a section of the base portion 25 which is cut away to create a second aperture 41. Magnet 33, upon being seated in the first aperture 31, may be held in place by friction fitting, glue, tape, adhesive etc.

A ball marker 35 can be made from a multitude of materials, but at least one surface is of a ferrous metal having a magnetic attraction. Ball marker 35 is of a size and shape that it may be placed within the retaining wall 21, with one surface juxtaposed against the magnet 33 and firmly held by the embedded magnet 33 until dislodged by a greater force. A wing extension 37 encircles the retaining wall 21 and is disposed between the outer and inner surfaces 46, 44 and is sewn into the outer surface 46. A part of retaining wall 21 is removed to create a cutout section 43, which is in alignment with the second aperture 41. The user only has to depress the rim of ball marker 35 (that is the section above the second aperture 41) into second aperture 41, as illustrated in FIG. 3. This action urges ball marker 35 to flip up and slide out of the holder 20, where it may easily be removed with the use of only one hand. It is an important consideration, that at the cutout section 43, the plane of the retaining wall 21 is of a lower height than the rest of the wall 21 and is approximately level with the top surface of the magnet 33 and base portion 25. This allows the player to use a sliding one-handed motion to remove the marker 35.

It is to be understood that while certain forms of the present invention have been illustrated and described herein, it is not to be limited to the specific forms or arrangement of parts described and shown. An example may be wherein the materials of the ball marker 35 and the magnet 33 are reversed, i.e. the ball marker 35 be the made of magnetic material and the magnet 33 be made of a ferrous type material.

We claim as our invention:

1. A golf glove and a ball marker comprising:

the golf glove comprising:

fingers, a thumb, a back surface divided by an opening into a lateral portion adjacent the thumb and a medial portion, a closure assembly attached to the lateral portion and the medial portion, the closure assembly includes an inner surface and an outer surface when closed; and a ball marker holder comprising:

a retaining wall extending around at least a substantial portion of the ball marker and a cutout section defined by the removal of part of the retaining wall, a base portion within the retaining wall, the base portion having a first aperture defined therein, a magnet for magnetically holding the ball marker and the magnet of a size and shape configured to be received within the first aperture, and the first aperture having an edge section for receiving and securing the magnet such that the magnet is embedded within the holder and the bottom surface of the magnet is in contact with the clove, wherein the rigidity of the magnet does not restrict the movement of a golfer's hand, and the magnet cannot be accidentally dislodged and lost.

2. The golf glove and ball marker according to claim 1, wherein the base portion includes a second aperture being located proximate the cut out section.

3. The golf glove and ball marker according to claim 1, wherein the height of the retaining wall at the cutout section is approximately level with top surfaces of the base portion and the magnet.

4. The golf glove and ball marker according to claim 1, wherein the ball marker holder includes a wing extension integral with and substantially encircling the retaining wall.

5. The golf glove and ball marker according to claim 1, wherein the ball marker is made from a ferromagnetic material.

6. An article of clothing and a ball marker comprising:

the article of clothing having an inner and outer surface, and a ball marker holder comprising:

a retaining wall extending around a substantial portion of the ball marker, a cutout section defined by the removal of part of the wall, a base portion within the retaining wall, the base portion having a first aperture defined therein, a magnet for magnetically holding the ball marker and dimensioned to be received within the first aperture, the first aperture having an edge section around the perimeter for receiving and securing the magnet such that the magnet is embedded within the holder and the bottom surface of the magnet is in contact with the glove, and wherein the rigidity of the magnet does not restrict the movement of a golfer's hand, and the magnet cannot be accidentally dislodged and lost, a wing extension integral with and substantially encircling the retaining wall, the wing extension being coupled to the article of clothing between the outer surface and inner surface, wherein the rigidity of the magnet does not restrict the movement of a golfer's hand, and the magnet cannot be accidentally dislodged and lost.

7. The article of clothing and ball marker according to claim 6, wherein a second aperture is defined in the base portion and located proximate the cutout section.

8. A method of making a golf glove in combination with a golf ball marker holder, the method comprising of:

making a conventional golf glove having a glove closure assembly comprised of a flap having loop fastening fabric overlying an area of hook fastening fabric, the flap having outer and inner surfaces;

providing a magnet of a predetermined configuration;

providing a ball marker holder comprising of a generally circular retaining wall defining a perimeter, having an opening at one end and a base portion at the other end, a first aperture defined in the base portion, the first aperture having an edge section for receiving and securing the magnet such that the magnet is embedded within the holder and the bottom surface of the magnet is in contact with the glove, the holder having an integral wing extension encircling the retaining wall and a cut out section defined by a removed segment of the retaining wall;

fixing the magnet into the first aperture of the base portion; and covering the magnet and base portion with the ball marker.

* * * * *